US011517780B2

(12) United States Patent
Seaman et al.

(10) Patent No.: US 11,517,780 B2
(45) **Date of Patent: *Dec. 6, 2022**

(54) TRAMPOLINE EQUIPMENT AND METHODS

(71) Applicant: Action Sports Equipment Pty Ltd., Silverwater (AU)

(72) Inventors: Robert Brian Seaman, Silverwater (AU); David Andrew Jones, Silverwater (AU); Murray David Kirby Hunter, Silverwater (AU); Lee David Blattmann, Silverwater (AU)

(73) Assignee: Action Sports Equipment Pty Ltd., Silverwater (AU)

( * ) Notice: Subject to any disclaimer, the term of this patent is extended or adjusted under 35 U.S.C. 154(b) by 151 days.

This patent is subject to a terminal disclaimer.

(21) Appl. No.: 17/025,184

(22) Filed: Sep. 18, 2020

(65) Prior Publication Data

US 2021/0060371 A1 Mar. 4, 2021

Related U.S. Application Data

(63) Continuation of application No. 16/072,337, filed as application No. PCT/AU2017/050072 on Jan. 27, 2017, now Pat. No. 10,806,958.

(30) Foreign Application Priority Data

Jan. 27, 2016 (AU) ..... 2016900233

(51) Int. Cl.
*A63B 5/11* (2006.01)
*A63B 21/00* (2006.01)
*A63B 21/04* (2006.01)
*A63B 21/02* (2006.01)

(52) U.S. Cl.
CPC ..... *A63B 5/11* (2013.01); *A63B 21/00072* (2013.01); *A63B 21/0414* (2013.01); *A63B 21/02* (2013.01)

(58) Field of Classification Search
CPC ..... A63B 5/11; A63B 21/00072; A63B 21/02; A63B 21/0414; F16G 11/00–12
See application file for complete search history.

(56) References Cited

U.S. PATENT DOCUMENTS

2017/0001054 A1* 1/2017 Liu ..... A63B 5/11

* cited by examiner

*Primary Examiner* — Jennifer Robertson
(74) *Attorney, Agent, or Firm* — Mai-Tram D. Lauer; Westman, Champlin & Koehler P.A.

(57) ABSTRACT

A lever for use in a trampoline includes a frame attachment, a rigid element and a tensioner. The frame attachment is configured for connection to a supporting frame of the trampoline; the frame attachment includes a stop formation. The rigid element is connected to the frame attachment and is configured to pivot about a fulcrum connected to the frame attachment. The rigid element includes a lug configured to contact the stop formation to limit an extent of a pivot motion of the rigid element about the fulcrum. The rigid element comprises a jump mat end and a frame end, the jump mat end being configured for connection to a jumping mat. The tensioner is connected to the rigid element and is configured for attachment to the trampoline supporting frame.

20 Claims, 14 Drawing Sheets

TRAMPOLINE EQUIPMENT AND METHODS

CROSS-REFERENCE TO RELATED APPLICATIONS

This Application is a continuation of U.S. patent application Ser. No. 16/072,337, filed on Jul. 24, 2018; which is a Section 371 National Stage Application of International Application No. PCT/AU2017/050072, filed 27 Jan. 2017, and published as WO 2017/127899 A1 on Aug. 3, 2017, in English. International Application No. PCT/AU2017/050072 claims the benefit of priority of Australian application AU 2016900233, filed Jan. 27, 2016. The contents of these priority applications are hereby incorporated by reference in their entirety.

FIELD OF THE INVENTION

The present invention relates to a trampoline, and more particularly to tensioners for trampolines.

BACKGROUND TO THE INVENTION

A trampoline, at its essence, comprises: a jumping mat connected via tensioners to a frame, which frame is connected to the ground either directly or through legs.

Standard above-ground trampolines are suspended above the ground by legs attached to the frame. In-ground trampolines have little or no distance between the bouncing mat and the ground.

In-ground trampolines typically have the frame connected directly to the ground, but in some instances, an above-ground trampoline can simply be placed in a hole dug to a depth such that the jumping mat is level with the ground. In both above-ground trampolines and in-ground trampolines, the use of safety enclosure nets is becoming commonplace.

Tensioners have traditionally been helical springs laid axially between the jumping mat and a frame. Helical springs are still widely used in use in trampolines in this configuration.

Helical springs have problems in that they have spaces between them and this can result in limbs of a user falling between the springs. This often results in injury. Also, when the springs contract while a person's exposed skin is against the spring, this results in pinching injuries. To ameliorate this, padding that covers the springs and mat-engaging enclosures have been used. Unfortunately, padding can shift and the enclosures can fail over time or be incorrectly installed, both of which can lead to injury. These safety items also add to the cost of the trampoline.

Other tensioners are also known. For example elastomeric bands can be used instead of helical springs, such as described in Australian patent no. 2010291951. They also have similar safety issues to those found in helical springs. They additionally typically degrade more quickly than helical springs and are also typically only used in trampolines for lightweight users.

One problem with traditional trampolines is that the jump mat area is reduced by the tensioners that are used as the tensioners take up space. This has been solved by the use of rods and leaf-spring plates that do not require a substantial axial area to be used for them.

Fibreglass rods, such as those described in U.S. Pat. No. 6,319,174, have also been used to replace helical springs. These rods are diagonally arranged around the trampoline jumping mat and resiliently collapse down when a user jumps on the jumping mat. The rods have potential disadvantages in that they have a gap between rods that reduces when the user jumps on the trampoline that can cause an observer who has a limb between two of the diagonal rods to be closed in upon when the rod gap is reduced. Another potential issue is that if a user is bouncing near the periphery of the jumping mat, the jumping characteristics of the jumping mat change from that in the centre, which is disagreeable for some users. A further issue is that some users have reported that the jumping performance of this type of tensioning system is sub-par compared to helical spring-based trampoline jumping performance. Some users have also reported premature degradation of the fibreglass rods.

Leaf spring plates have also been employed, such as described in WO2012/167313. Leaf springs have the disadvantage that they are relatively heavy compared with rods or helical springs and are also generally more expensive to produce. Another technical issue is that if the connection between the jumping mat and the leaf spring fails or becomes detached then the leaf spring can become a generally upright spear-like projection that can pose a safety hazard.

It would be desirable to have a trampoline that ameliorates at least some of the above-mentioned disadvantages or at least provides the public with a useful choice.

Nothing above should be read as necessarily falling within the common general knowledge.

Definitions

In this specification, unless the context indicates otherwise:

1. "above" means located on a horizontal plane elevated above another location on a lower horizontal plane. This does not necessarily require that the positions being compared to be directly above (i.e. not necessarily at the same horizontal position on parallel horizontal planes);
2. "beneath" means located on a horizontal plane lower than another location on a higher horizontal plane. This does not necessarily require that the positions being compared to be directly beneath (i.e. not necessarily at the same horizontal position on parallel horizontal planes);
3. "connected" means directly connected as well as indirectly connected;
4. "jumping periphery" means the outermost border of a jumping mat that a trampoline user has access to while still being inside the usable area of the jumping mat;
5. "circumextending" means surrounding the periphery of another object in a closed loop. In the context of a trampoline, the jumping periphery of the jumping mat is typically surrounded. The object that is surrounded can be of any shape, such as circular, rectangular and polygonal;
6. "tensioner" means any resiliently deformable member that allows the jumping mat to deform from its resting configuration when a user jumps on the jumping mat with sufficient force and then forces the jumping mat to resiliently return towards its resting configuration to apply sufficient force in conjunction with other tensioners to the user such that the user is propelled upwards to become briefly airborne;
7. "first class lever" is a lever where the fulcrum is located between the load and the effort;
8. "proximal" or "proximate" means situated at or near a defined location;
9. "rest" in the context of a tensioner is when the jumping mat is not being jumped on;

10. "comprise", or variations such as "comprises" or "comprising", will be understood to imply the inclusion of a stated element, integer or step, or group of elements, integers or steps, but not the exclusion of any other element, integer or step, or group of elements, integers or steps.

The art-skilled worker will appreciate that the above definitions can and should, with suitable consideration for context, apply to the singular and the plural, and also to the tense of verbs, nouns, adjectives and adverbs derived from the above terms.

SUMMARY OF THE INVENTION

In a first aspect, the present invention provides a trampoline comprising:

a) a jumping mat having a jumping periphery, an upper surface and lower surface;
b) a supporting frame located proximal but not directly engaging with the jumping periphery of the jumping mat;
c) a plurality of levers circumextending the jumping periphery;
d) each of the plurality of levers comprising:
   i. a rigid element connected to the supporting frame;
   ii. which rigid element comprises a jump mat end and a frame end;
   iii. which rigid element pivots about a fulcrum connected to and supported by the supporting frame;
   iv. the jump mat end being connected to the jumping mat at a jumping mat connection located proximal the jumping periphery;
   v. a tensioner connected between the lever at a tensioner attachment and the supporting frame; and
e) each lever and tensioner configured to apply tension to the jumping mat in the form of a force applied against the jumping periphery of the jumping mat in a direction away from the jumping mat.

In a further aspect, the present invention provides a lever for use in a trampoline comprising:

a) a rigid element connected to a supporting frame attachment adapted to attach to a trampoline supporting frame;
b) which rigid element comprises a jump mat end and a frame end;
c) which rigid element pivots about a fulcrum connected to a second supporting frame attachment adapted to attach to a trampoline supporting frame;
d) the jump mat end being connected a jumping mat connection adapted to connect to a jumping mat; and
e) a tensioner connected between the lever at a tensioner attachment and a third supporting frame attachment adapted to attach to a trampoline supporting frame.

In a yet further aspect, the present invention provides a method of tensioning a trampoline comprising:

a) providing a trampoline, the trampoline comprising:
   i. a jumping mat having a jumping periphery, an upper surface and lower surface;
   ii. a supporting frame located proximal but not directly engaging with the jumping periphery of the jumping mat;
b) providing a plurality of levers circumextending the jumping periphery, each of the plurality of levers comprising:
   i. a rigid element connected to the supporting frame;
   ii. which rigid element comprises a jump mat end and a frame end;
   iii. which rigid element pivots about a fulcrum connected to and supported by the supporting frame;
   iv. the jump mat end being connected to the jumping mat at a jumping mat connection located proximal the jumping periphery;
   v. a tensioner connected between the lever at a tensioner attachment and the supporting frame; and
c) wherein each lever and tensioner applies tension to the jumping mat in the form of a force applied against the jumping periphery of the jumping mat in a direction away from the jumping mat.

BRIEF DESCRIPTION OF THE DRAWINGS

The invention is described below with reference to non-limiting drawings in which.

DETAILED DESCRIPTION OF THE INVENTION

Figure 1:
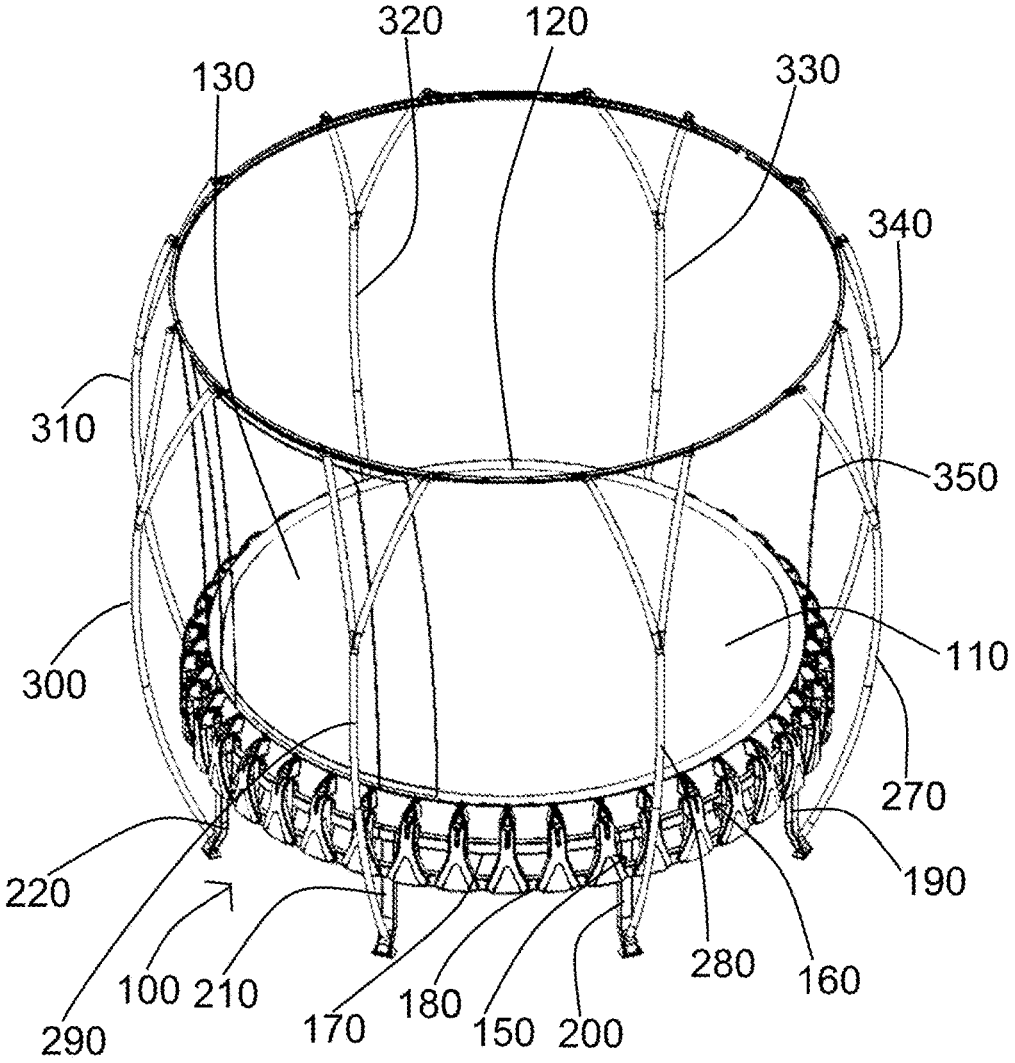
FIG. 1 is a perspective view of a trampoline.

Tensioners in the industry cover a variety of tensioning devices, most of which are generally elongate. A generally elongate tensioner when used in the invention should preferably not be oriented generally horizontally but more preferably should be generally vertically oriented.

A single tensioner per lever is currently preferred, but multiple tensioners per lever are also contemplated. If multiple tensioners are employed then these are preferably arranged in an arc splaying at one end thereof from the lever at the tensioner attachment and attached at the opposite end thereof spaced apart to the frame. More preferably, the multiple tensioners should be bilaterally symmetrically arranged to minimise differential forces on the lever. In one embodiment, two tensioners per lever are provided. In an alternative embodiment, three tensioners are provided per lever.

In a currently preferred embodiment, the tensioner is a helical steel spring. However, other tensioners known in the art can be employed, such as elastomeric bands, for example as described and illustrated in WO 2011/032173 (incorporated in its entirety by reference). If a helical steel spring is employed, this is preferable an extension spring, compression spring or trace spring, more preferably an extension spring.

Each lever should preferably be moveable predominantly in one plane only, more preferably in a vertical plane perpendicular to the periphery of the mat nearest the jumping mat connection. It is most preferred for the lever to be practically moveable exclusively in one plane only.

It is currently preferred for the lever to have a rest orientation when installed that is slightly off-vertical facing slightly in the direction of the jumping mat.

Preferably, the lever is a first class lever. More preferably, the tensioner attachment is located proximal the frame end.

It is currently preferred for the fulcrum to be a bearing, more preferably that the rigid element is connected to the supporting frame through the bearing. The bearing in a currently preferred embodiment is integrally moulded into the rigid element.

In a currently preferred embodiment, the rigid element is moulded with an integrated pivot as a single moulding. If an engineering thermoplastic polymer is used to manufacture the lever, it should preferably have the properties of high stiffness, low friction and excellent dimensional stability.

Conveniently, this can be achieved using a polyoxymethylene (POM) polymer. Friction can be reduced further using a polytetrafluoroethylene (PTFE) additive to form a copolymer. More preferably, the PTFE should comprise about 2% of the total polymer.

Other polymer options are available in the industry that are suited to this type of application and will be well-known to plastics manufacturers, include, but are not limited to: composite phenolics, nylon (especially glass-filled, graphite and molybdenum disulphide filler varieties), PTFE (especially when filled with fiberglass, graphite or other inert materials), ultrahigh-molecular-weight polyethylene (UHMWPE) and polyamide (especially incorporating graphite). Polysulfone and polyphenylene sulphide are also useful as bearing surface coatings.

The second supporting frame attachment is preferably moulded from a different material from the pivot and rigid element that at the bearing interface (pivot) with the rigid element assists in extending the life of the bearing. In one embodiment, it is moulded from a harder wearing material than the pivot material, preferably glass filled Nylon, more preferably 30% glass fibre reinforced nylon.

Alternatively, a sleeve bearing can be used or a metal (preferably steel) pin as a bearing at the pivot between the second supporting frame attachment and the rigid element.

While plastics are the preferred material for the second supporting frame attachment, pivot and the rigid element, other materials known in the art can equally be used, such as metal (e.g. cast steel or aluminium).

The jumping mat connection is currently preferred to be on the lower surface of the jumping mat. In one embodiment, the jumping mat connection is a formation on the lower surface of the jumping mat with a complementary engaging formation attached to the jump mat end of the elongated rigid element, more preferably wherein the formation on the lower surface of the jumping mat is a hook and the complementary engaging formation is a loop.

Preferably, the supporting frame is located beneath the jumping mat. More preferably the supporting frame comprises a generally horizontal bar, most preferably comprising an upper bar and lower bar that are spaced apart, parallel and generally horizontal.

In one embodiment, the tensioner is attached to the frame on the lower bar and the fulcrum is connected to the upper bar. In use, the jump mat end is preferably located beneath the jumping mat.

In a currently preferred embodiment, the tensioner is protected by a cover, preferably a plastics cover. This can help to preserve the tensioner and also helps to prevent a user from contacting the tensioner and thereby helps to minimise injuries.

Preferably, between 30 and 60 levers are arranged and evenly spaced around the jumping mat of a trampoline, depending on the size of the trampoline and the required bounce performance. The larger the trampoline, the more levers will be required. Competitive bounce performance will also require more levers. The considerations for determining the number of levers are well-known to art-skilled workers for trampolines already used in the industry and the same considerations apply in the present invention.

In a particularly preferred embodiment, the rigid element has an over-extension arrester to prevent over-extension of the rigid element during use. This can be in the form of a stop that engages at maximum extension of the rigid element during heavy load.

EXAMPLES

The invention is described below with reference to examples. The examples are only preferred embodiments of one or more ways that the invention can be carried out and should not be read as limiting the scope of the invention.

Figure 2:
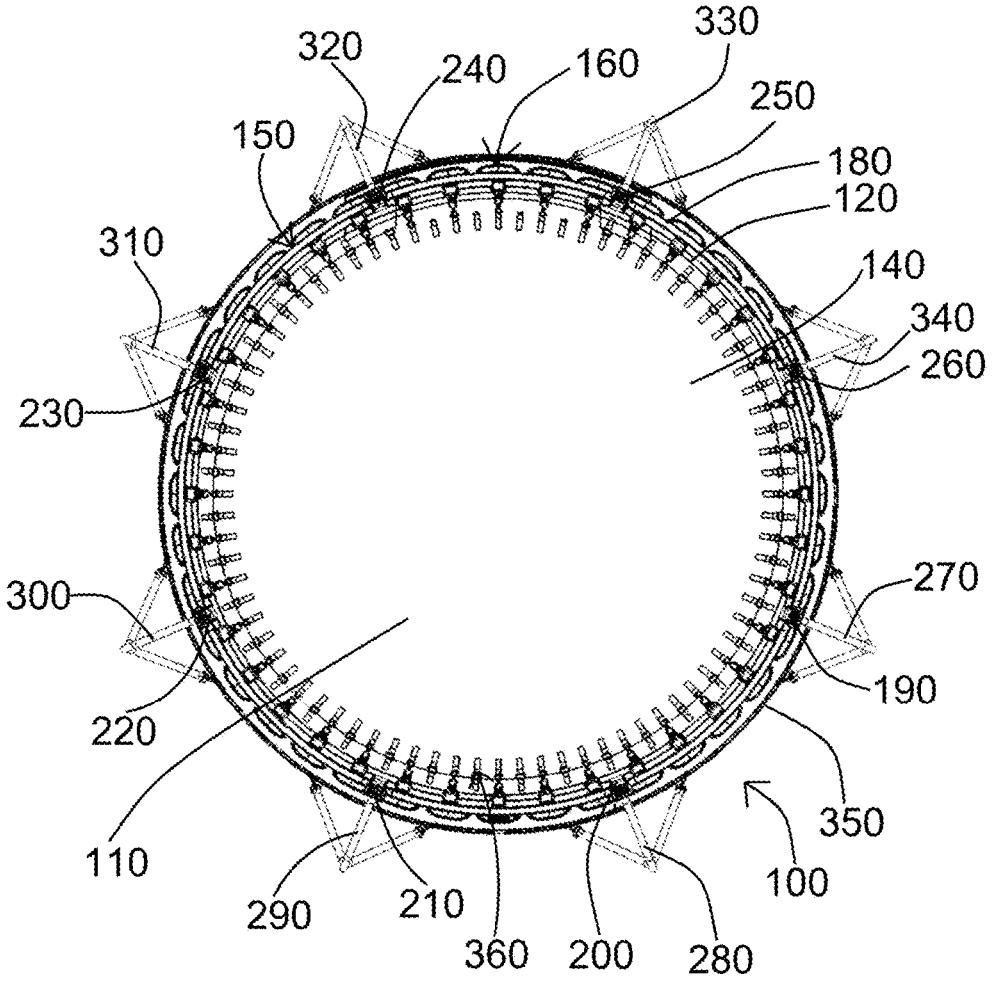
FIG. 2 is a bottom view of the trampoline of FIG. 1.
Figure 3:
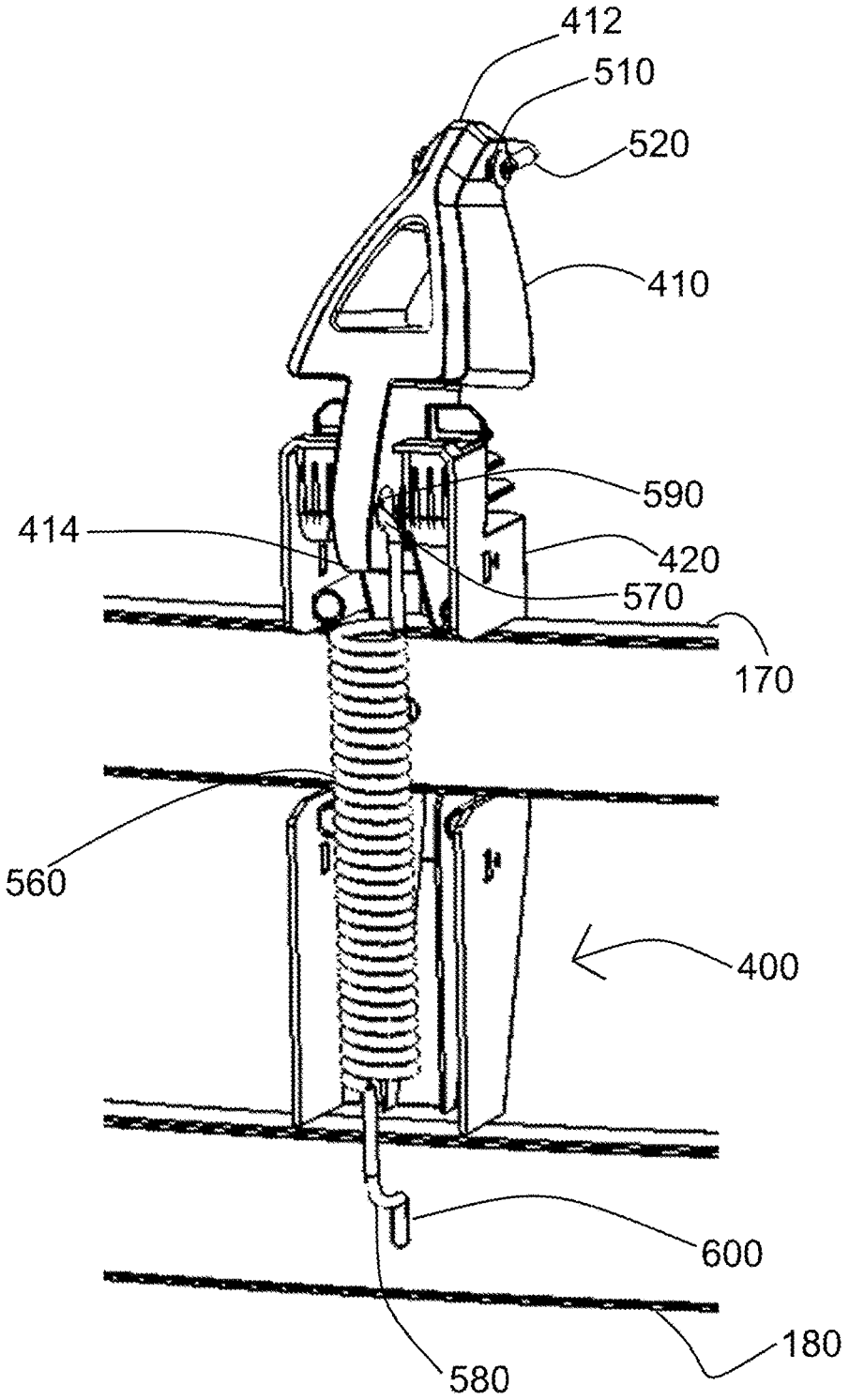
FIG. 3 is a perspective view of a lever with its cover removed to show the internal features thereof when attached to a trampoline frame.

With reference to FIG. 1 and FIG. 2, a trampoline, generally indicated as 100, has a jumping mat 110 having a jumping periphery 120, an upper surface 130 and lower surface (not shown in this Figure).

A supporting frame, generally indicated as 150, is located proximal but not directly engaging with the jumping periphery 120 of the jumping mat 110. A plurality of levers, generally indicated as 160, circumextend the jumping periphery 120—a total of 42 evenly spaced levers. The frame is modular consisting of a series of joined together segments (not shown).

The supporting frame 150 is located beneath the jumping mat 110. The supporting frame 150 comprises an upper bar 170 and lower bar 180 that are spaced apart, parallel and generally horizontal. The upper bar 170 and 180 are supported by a plurality of legs 190, 200, 210, 220, 230, 240, 250, 260.

The plurality of legs 190, 200, 210, 220, 230, 240, 250, 260 have a plurality of enclosure bifurcated supports 270, 280, 290, 300, 310, 320, 330, 340 attached near the base of the legs 190, 200, 210, 220, 230, 240, 250, 260. The enclosure supports 270, 280, 290, 300, 310, 320, 330, 340 support an enclosure net 350. Enclosure net 350 is attached at its base to the lower surface 140 of the jumping mat 110 using a plurality of net attachments, generally indicated as 360.

Each of the plurality of levers 160 is as depicted in FIGS. 3, 4, 5, and 6, which is now described. Elements already described above are numbered in the drawings for context and represent the same features already described above. These will not be re-described here in the interests of succinctness.

A lever 400 has a rigid element 410 with a jump mat end 412 and a frame end 414. The frame end 414 is connected to upper bar 170 via a fulcrum in the form of a bearing 416 to an upper bar housing 420 composed of 30% glass fibre reinforced nylon. Upper bar housing 420 is secured to upper bar 170 via coach bolt 430 and nut 440. The upper bar housing 420 has strengthening ribs 450, 460, 470, 480, 490, 500 proximal its upper end. The bearing 416 is received within a corresponding aperture (not shown) within upper bar housing 420.

The jump mat end 412 has a hole 510 through which a wire loop 520 is passed. A jumping mat connection 530 is made up of a fabric loop 540 and hook 550. The fabric loop 540 is sewn to the lower surface 140 of the jumping mat 110. The hook 550 passes through the fabric loop 540 and is, in use, hooked through the wire loop 520 to secure the jumping mat 110 to the rigid element 410.

A helical spring tensioner 560 is an elongate extension spring that has a rigid element hook 570 at one end and a lower bar hook 580 at the other end thereof. Rigid element 410 has a tensioner hole 590 formed proximal its frame end 414. Lower bar 180 has a vertically oriented slot 600 formed therein.

To attach the spring tensioner 560, the lower bar hook 580 is passed through aperture 600. The rigid element hook 570 is passed through the tensioner hole 590. The rigid element is biased by hand towards the trampoline mat 140 and the hook 550 is hooked to the wire loop 520. The tension so-formed retains the spring tensioner 560 in position and vertically oriented and biases the jumping mat end 414 away from the jumping mat 110.

The enclosure net 350 attaches to the lower surface 140 of the jumping periphery 120 by net attachments 610, 620, which are a subset of the plurality of attachments 360 shown in FIG. 2. The jump mat end 412 is located below the jump mat 110.

Helical spring tensioner 560 is protected by a plastics cover 630.

Figure 5A:
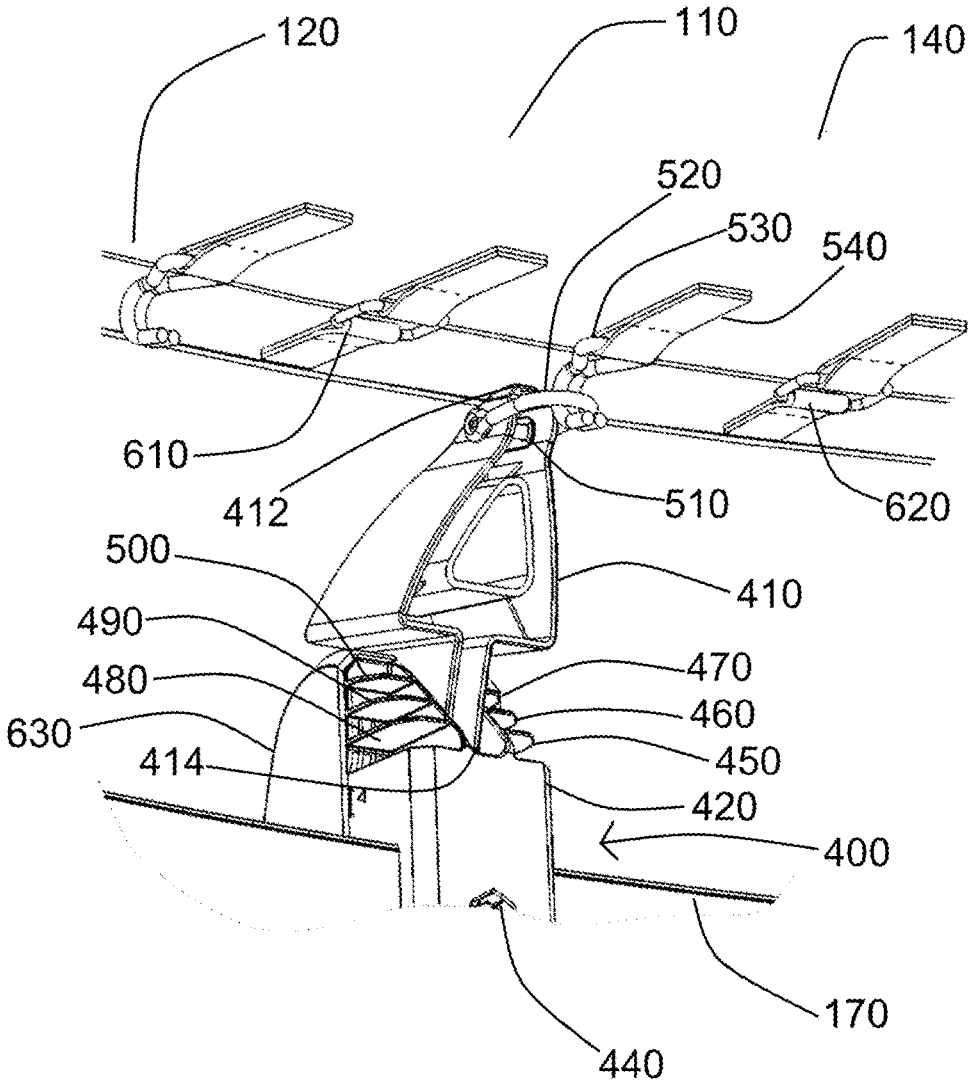
FIG. 5*a* shows a cut-away rear perspective view showing a lever attachment to a trampoline frame and a jumping mat.
Figure 5B:
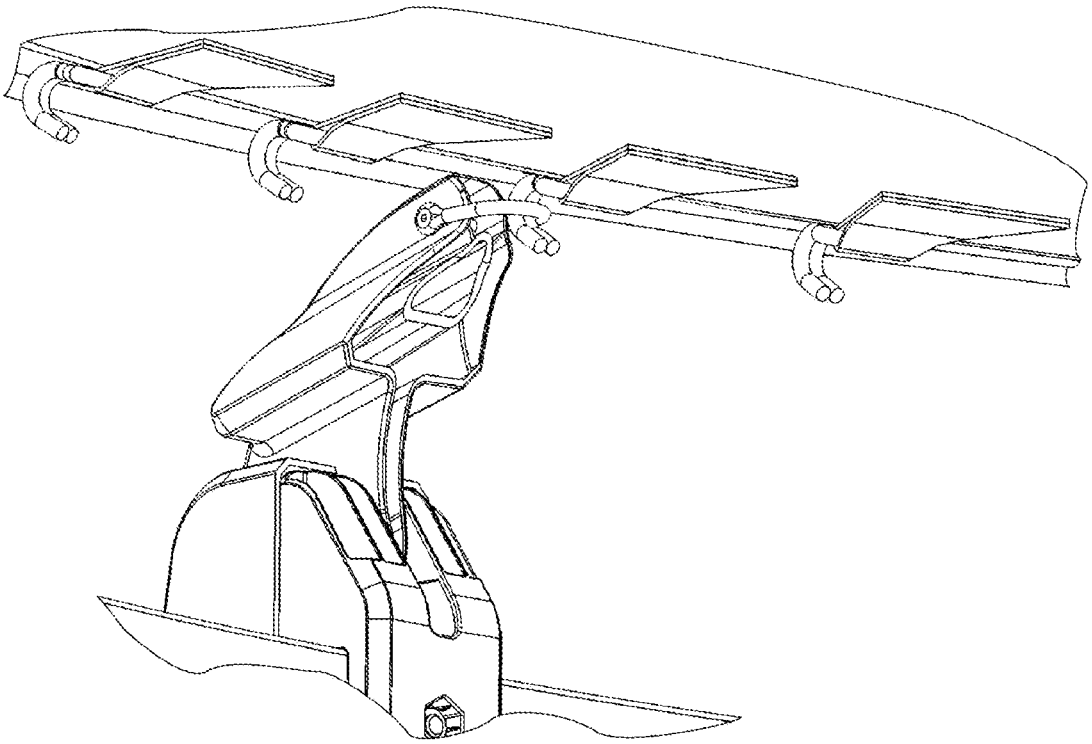
FIG. 5*b* shows a cut-away rear perspective view showing a presently preferred lever attachment to a trampoline frame and a jumping mat.
Figure 6:
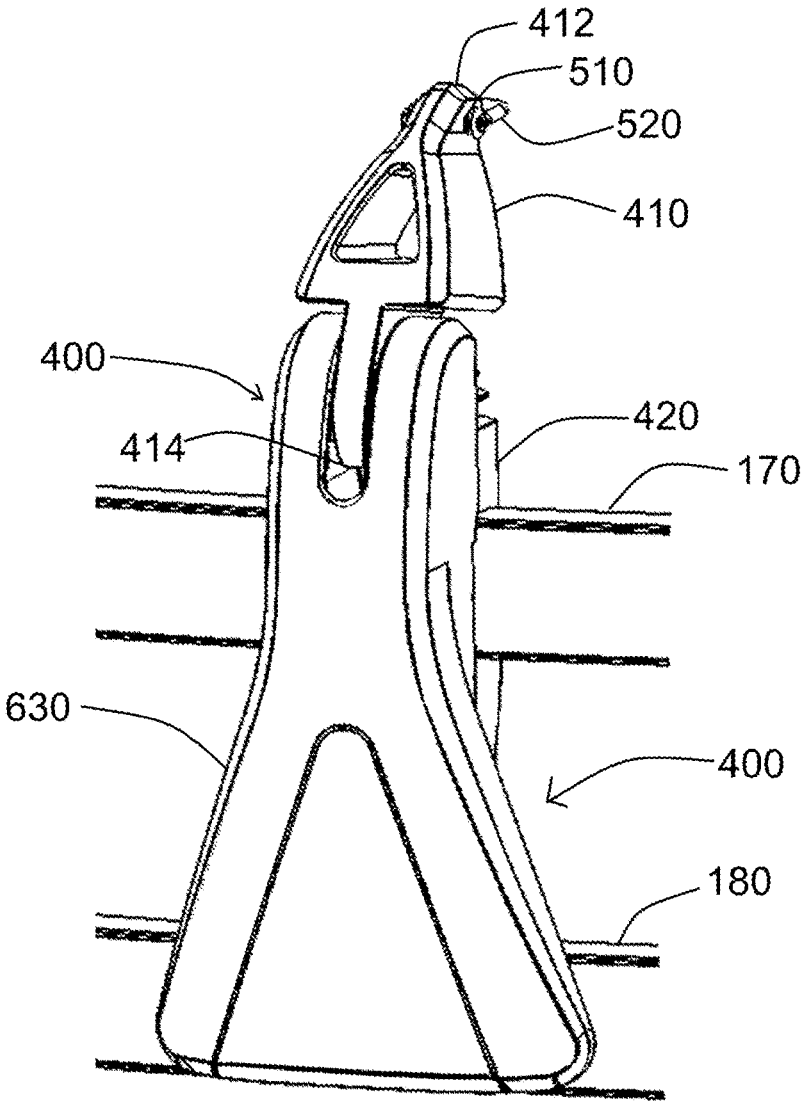
FIG. 6 is a perspective view of a lever with its cover when attached to a trampoline frame.

With reference to FIG. 5*b*, this depicts a currently preferred embodiment that is the same arrangement as shown in FIG. 5*a*, except that vertical ribs are depicted instead of horizontal ribs. Also, there are no net attachments as these are shared with the jump mat connectors.

Figure 7:
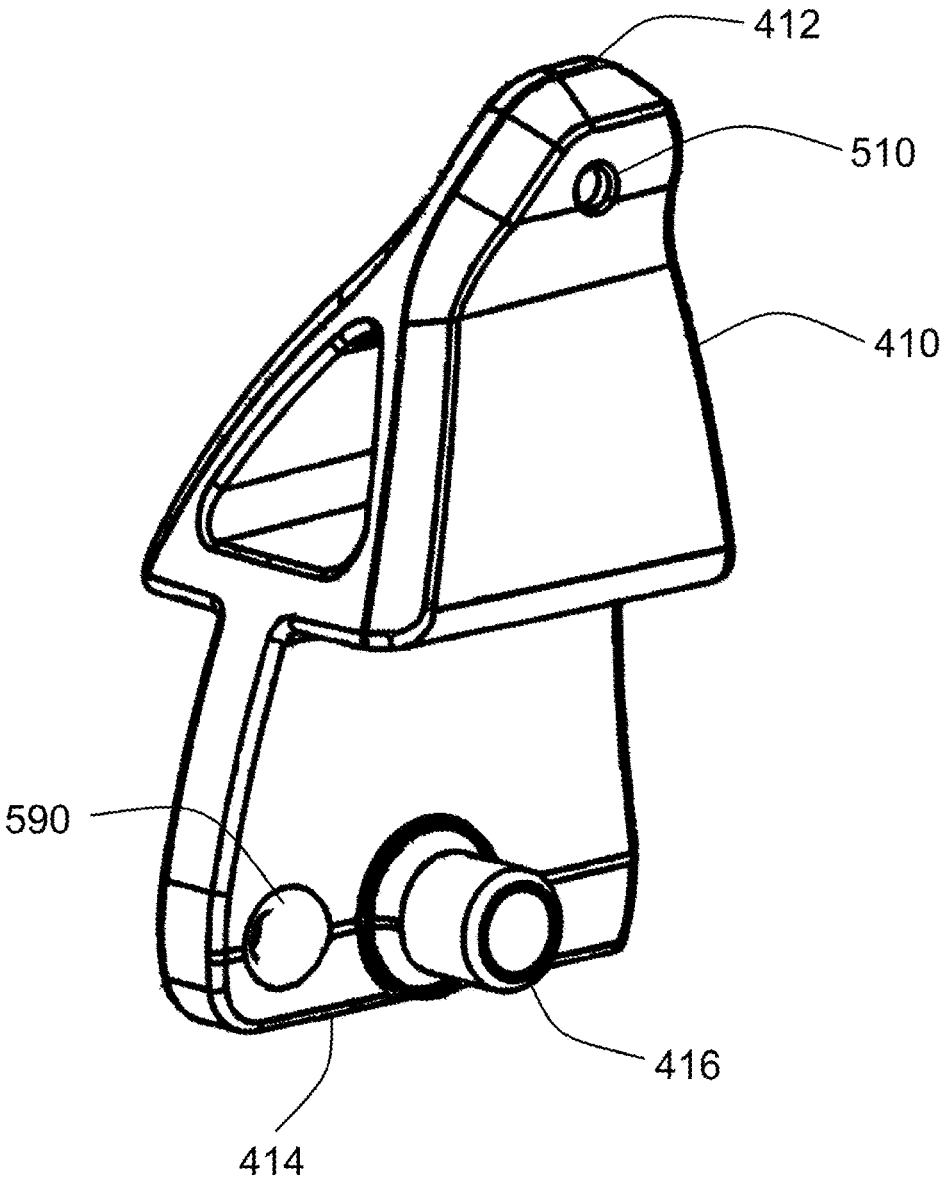
FIG. 7 is a perspective right side view of a rigid element of a lever.

With reference to FIG. 7, the rigid element 410 is moulded with a bearing 416 that is integrated using a single moulding using a copolymer of 2% polytetrafluoroethylene (PTFE) and polyoxymethylene (POM). In use, the bearing 416 engages with a corresponding aperture in upper bar housing 420 (illustrated and described in relation to other figures above—the aperture is not illustrated).

Figure 4:
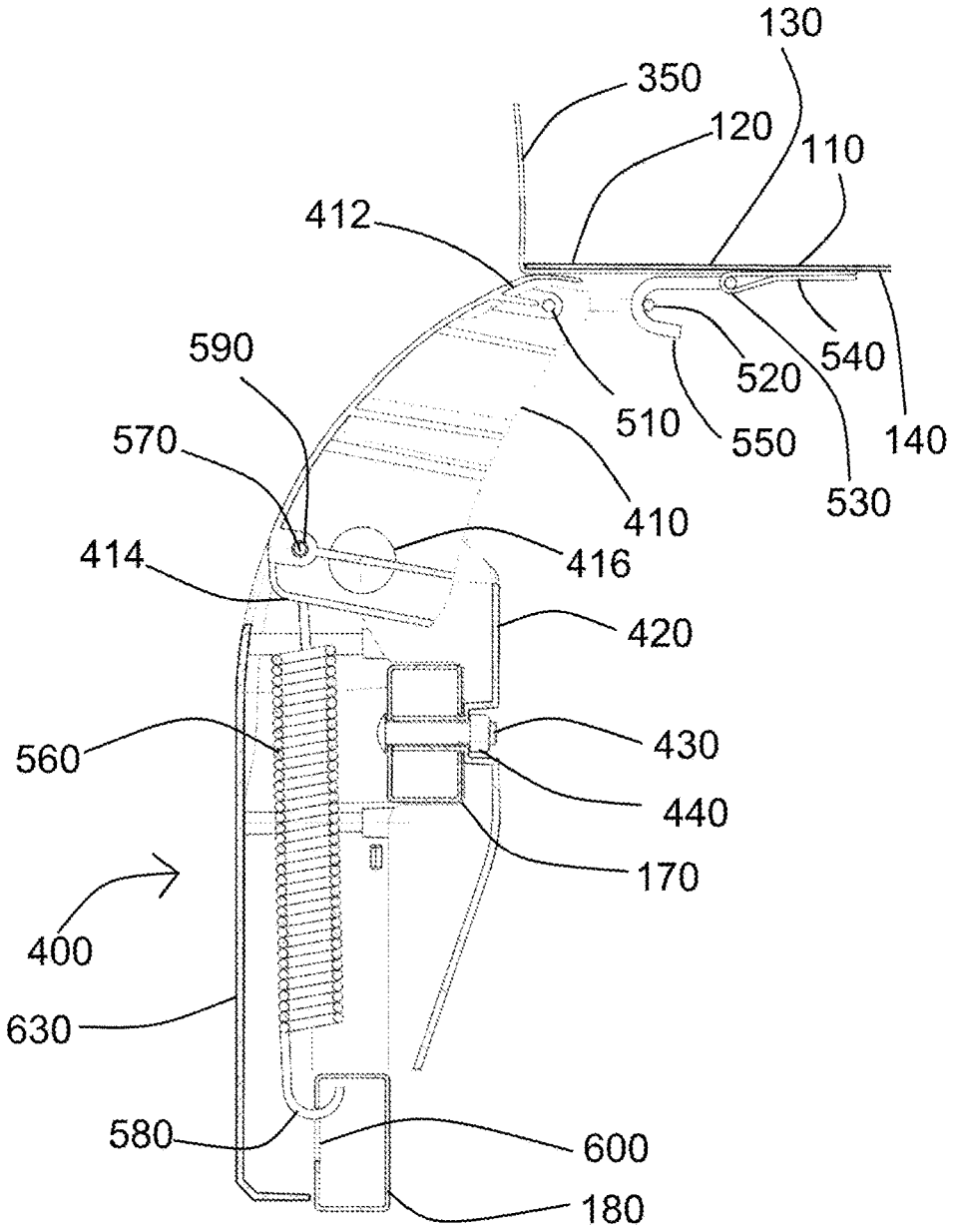
FIG. 4 shows a sectional side view through a lever when attached to a trampoline frame and a jumping mat.

With reference to FIG. 4, the rigid element 410 is rotatable about bearing 416 only in a vertical plane perpendicular to the jumping periphery 120 nearest the jump mat connection 530. In use, the lever rigid element 410 has a rest position when installed that is off-vertical facing slightly in the direction of the jumping mat 110. This is as it is depicted in FIGS. 3 to 6. When under jumping tension, the rigid element 410 rotates about bearing 416 with jump mat end 412 moving inwards and downwards in the direction of mat 110 (not shown).

Figure 8:
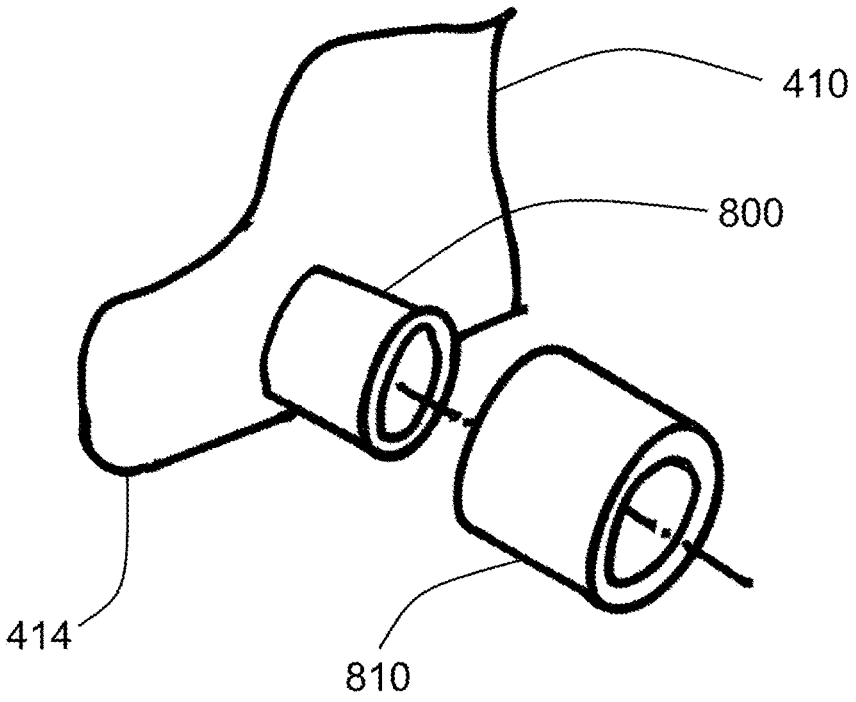
FIG. 8 is a perspective cut-away right front side view of an alternative bearing embodiment of a rigid element.

An alternative bearing arrangement is shown in FIG. 8, where a cut-away portion of rigid element 410 at frame end 414 thereof has a cylindrical protrusion 800. A PTFE sleeve 810 is slipped over the cylindrical protrusion 800. In use the PTFE sleeve 810 is interposed between cylindrical protrusion 800 and a corresponding aperture in upper bar housing 420 (illustrated and described in relation to other figures above—the aperture is not illustrated).

Figure 9:
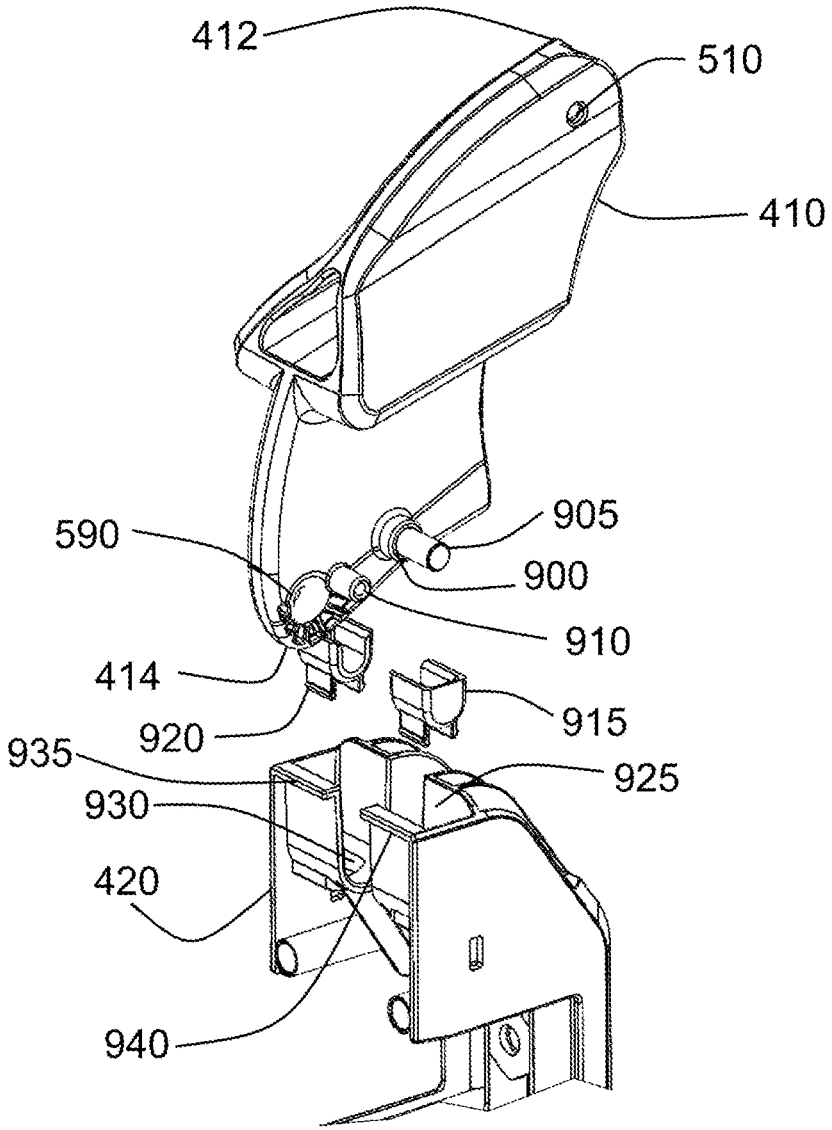
FIG. 9 is a perspective cut-away right front side view of a second alternative bearing embodiment of a rigid element.

A further alternative (and currently preferred) bearing arrangement is shown in FIG. 9.

The rigid element 410 with its jump mat end 412 and frame end 414 is moulded with an aperture 900 and hole 510. Also moulded is a lug stop 910 extending either side of the rigid element. Aperture 900 receives a stainless steel pin 905 through the aperture and protrudes either side of the rigid element 410.

A bearing pair 915, 920 composed of polyoxymethylene (POM) is received into the upper bar housing 420 in a pair of bearing mounts 925, 930. Stop formations 935, 940 are provided at the top of the bearing mounts 925, 930.

Rigid element 410 is installed into the upper bar housing 420 such that pin 905 seats into the pair of bearings 915, 920. In use, the pin 905 engages with the pair of bearings 915, 920 and permits the rigid element 410 to rotate in a vertical plane. Lug stop 910 engages with stop formations 925, 935 to prevent over-extension of the rigid element during heavy load.

Figure 10:
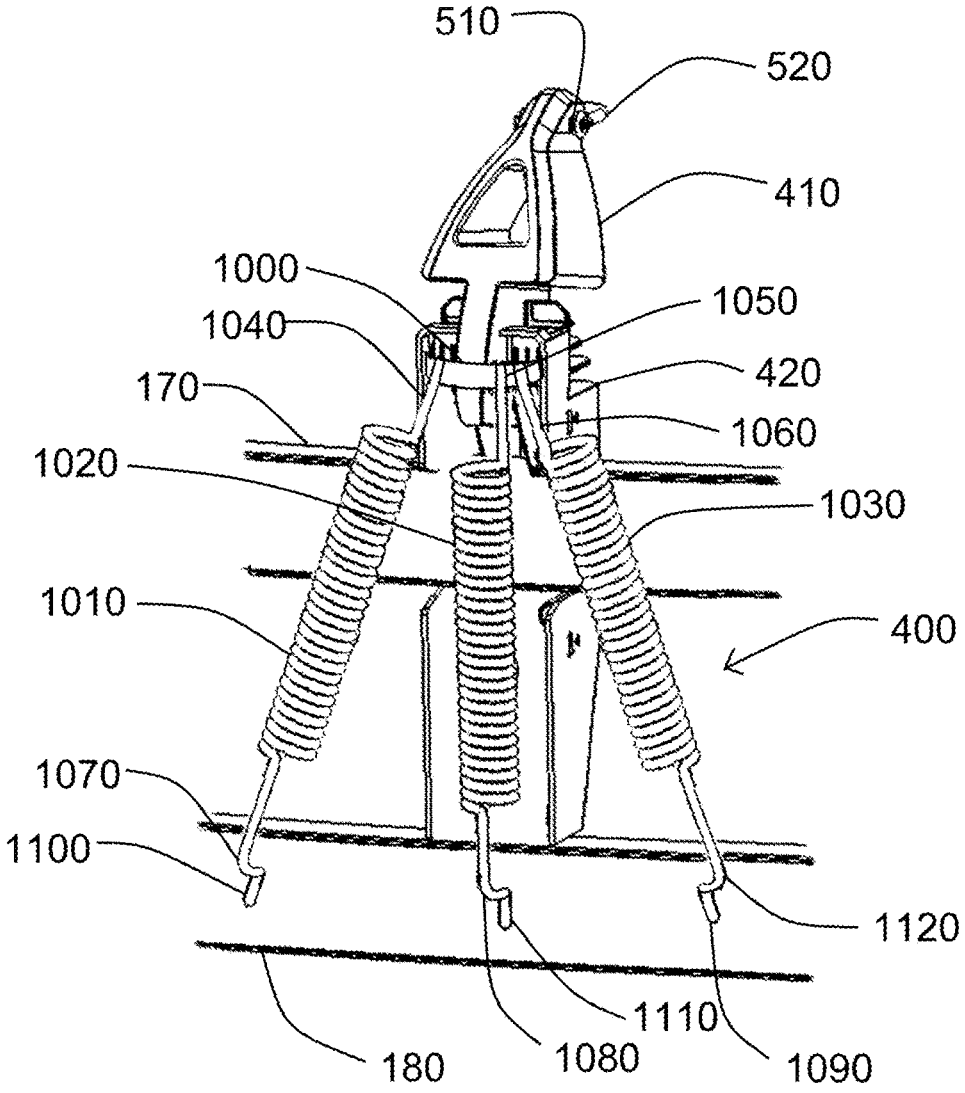
FIG. 10 is a perspective view of an alternative embodiment of a lever with multiple tensioners.

With reference to FIG. 10, an alternative multi-tensioner arrangement per lever is shown. Features that are the same as those depicted in other drawings are labelled but will not be re-described here in the interests of succinctness. A reader is directed to the descriptions of those features above, which are incorporated by reference.

A collar 1000 is rigid element 410 near the integrally formed with rigid element 410 proximal the frame end 414 thereof. Helical spring tensioners 1010, 1020 and 1030 that are steel extension springs have upper hooks 1040, 1050, 1060, respectively, and lower hooks 1070, 1080 and 1090, respectively. Lower bar has angled slot 1100, vertical slot 1110, and angled slot 1120 formed therein.

To attach the spring tensioners 1010, 1020, 1030, the lower hooks 1070, 1080 and 1090 are passed through the slots 1100, 1110 and 1120, respectively. The rigid element 410 is manually urged towards the hook 550 and the hook 550 is hooked to the wire loop 520. Upper hooks 1040, 1050 and 1060 are hooked around the upper surface of collar 1000. The tension so-formed retains the spring tensioners 1010, 1020, 1030 in position such that spring tensioner 1020 is vertically oriented while spring tensioner 1010 is angled in a bilaterally symmetrical fashion to spring tensioner 1030 so that the tensioners are splayed in an arc as depicted.

For all of the embodiments in FIGS. 1 to 10, in use, a user (not shown) jumps down on the upper surface 130 of the jumping mat 110. This induces a force pulling the jumping periphery 120 towards the centre of the jumping mat and downwards. This forces the jump mat end of 412 of the lever 400 of each of the plurality of levers 160 towards the mat 110 and downwards. Due to the biasing force provided by the spring tensioners (560 in one embodiment and 1010, 1020, 1030 in another embodiment), jump mat end 412 applies a force in the opposite direction away from the jumping periphery 120 and urges the rigid element 410 back to its resting position. This provides a force on the mat 100 experienced by the user (not shown) in an upward direction allowing them to become airborne.

Figure 11:
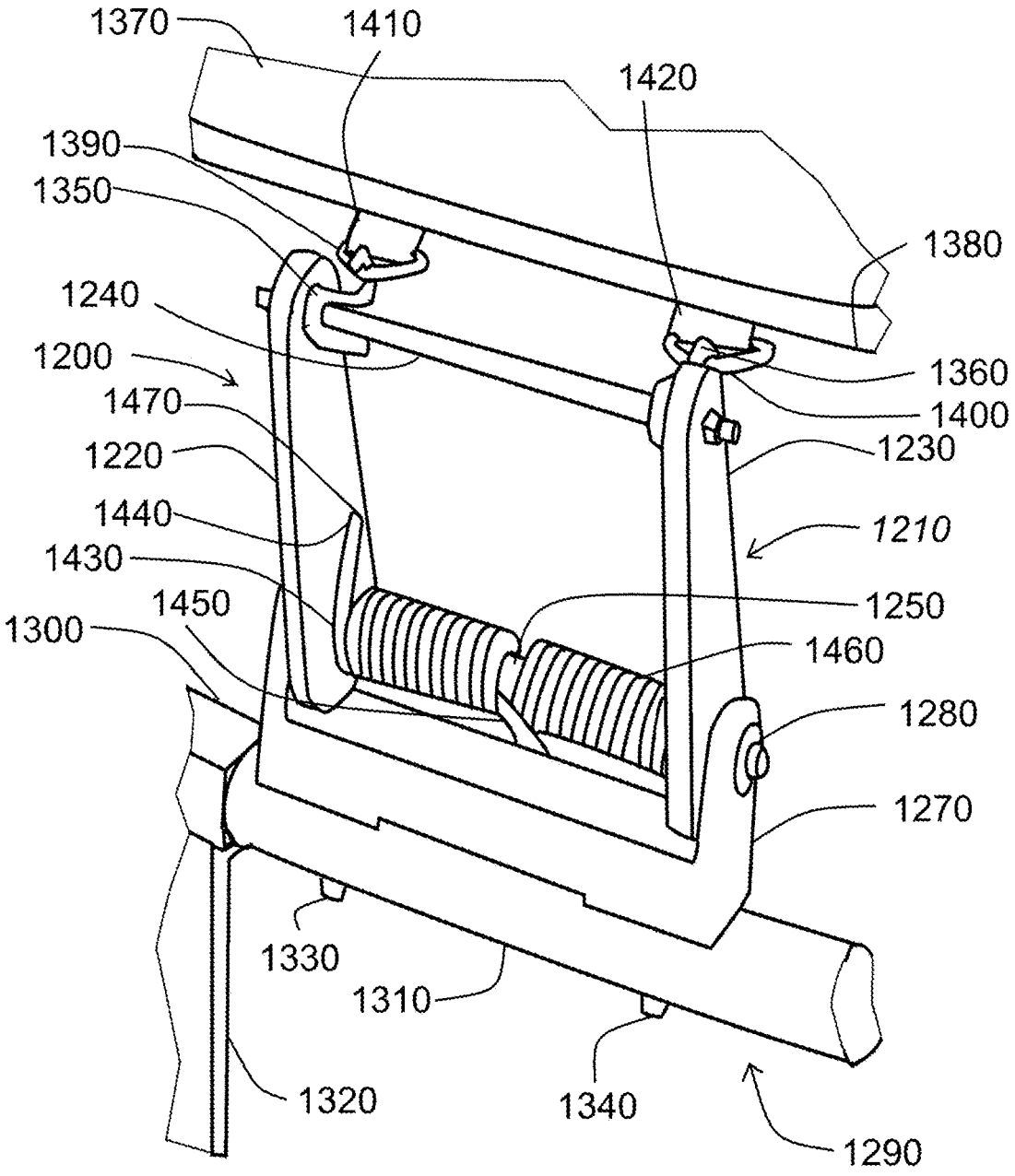
FIG. 11 is a perspective cut-away view of a torsional lever attached to a trampoline mat and frame.

With reference to FIG. 11, a lever generally indicated as 1200 has a rigid element 1210, generally indicated as 1210. The lever consists of arms 1220, 1230, a mat-end horizontal bar 1240 connected between the arms 1220, 1230 through holes (not shown) formed in the arms at one end thereof and a frame-end horizontal bar 1250 similarly assembled at the opposite end of the arms 1220, 1230. This causes the arms 1220, 1230 to move in concert in use.

The lever 1200 has a frame portion 1270 that the frame end horizontal bar is passed through via a bearing 1280 (the opposite side bearing is not shown).

A trampoline frame, generally indicated as 1290, is formed from a plurality of interconnected modular pieces, only one of each type is shown: a T-coupler 1300 connects an arcuate segment 1310 to a frame leg 1320. This is repeated to form a circular frame (not shown).

Frame portion 1270 has a pair of bolts 1330, 1340 that are passed through holes (not shown) formed in arcuate segment 1310 and fixed in place by nuts (not shown).

Mat-end horizontal bar 1240 has a pair of S-connectors 1350, 1360 that connect to a jumping mat 1370 at jumping mat periphery 1380. Delta loops 1390 and 1400 are directly connected to S-connectors 1350, 1360 (respectively) and are, in turn, connected to the jumping mat periphery 1380 by fabric loops 1410, 1420 (respectively).

A torsion spring 1430 having an arm-engaging end 1440 and frame engaging end 1450 is placed around the frame-end horizontal bar 1250. The arm-engaging end 1440 is threaded through a hole 1470 in arm 1220 and the frame engaging end 1450 is braced against frame portion 1270. A second torsion spring 1470 is similarly assembled onto 1250 and engaged with arm 1230 and frame portion 1270.

This arrangement is repeated around the periphery of the trampoline using a plurality of the levers 1200.

In use, at rest arms 1220, 1230 are substantially vertically orientated when under normal tension by jumping mat 1370. When a user exerts downward force on the jumping mat 1370, rigid element 1210 is rotated about frame-end horizontal bar 1270 using bearing 1270 so that mat-end horizontal bar 1240 moves inwards and downwards (not shown).

Torsion springs 1430 and 1470 exert a force in the opposite direction that urges rigid element 1210 to return to its at rest position. The user experiences this as an upward force that propels them in an upwards direction.

Figure 12:
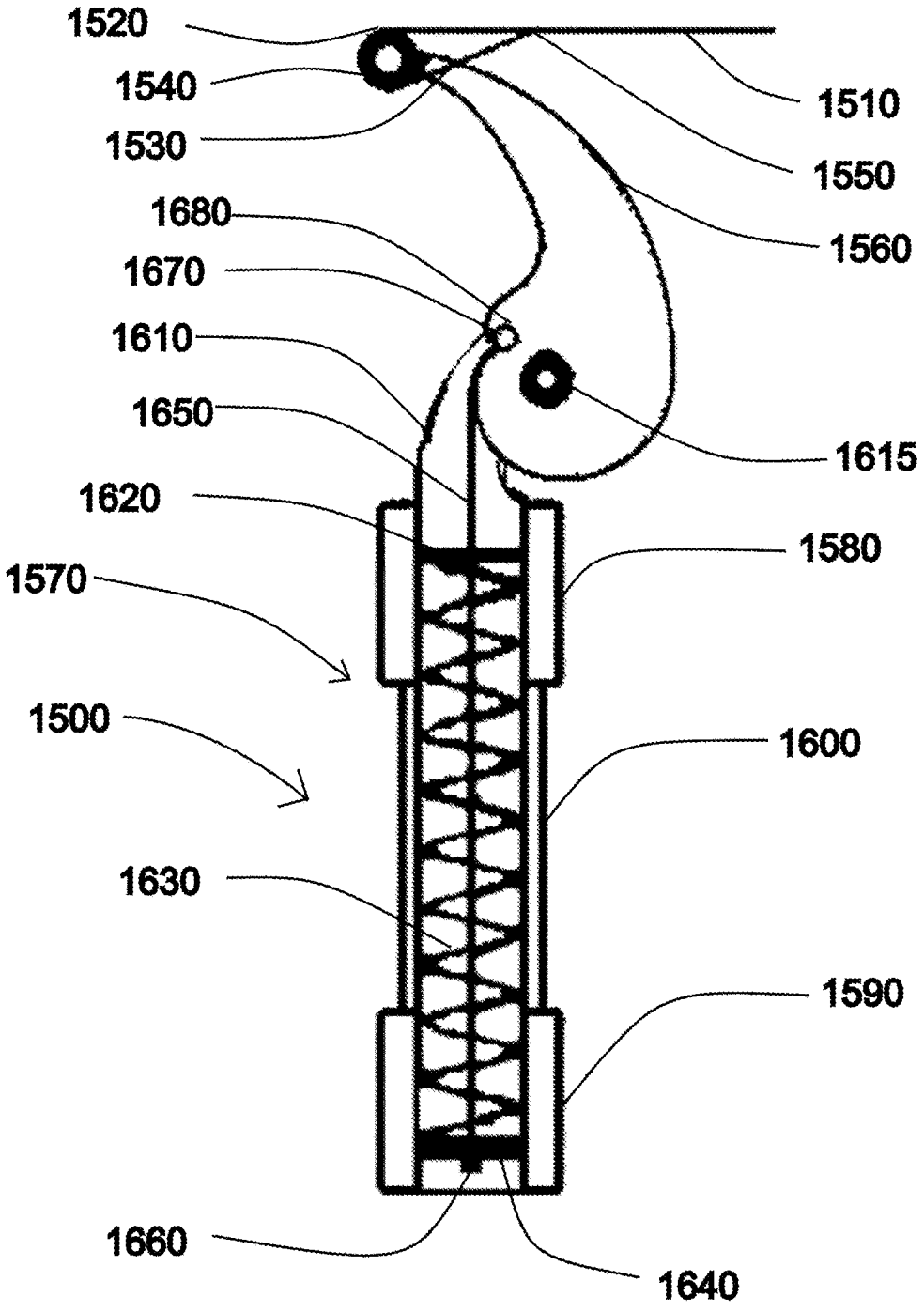
FIG. 12 is a sectional side view through a compression spring lever in its rest position.
Figure 13:
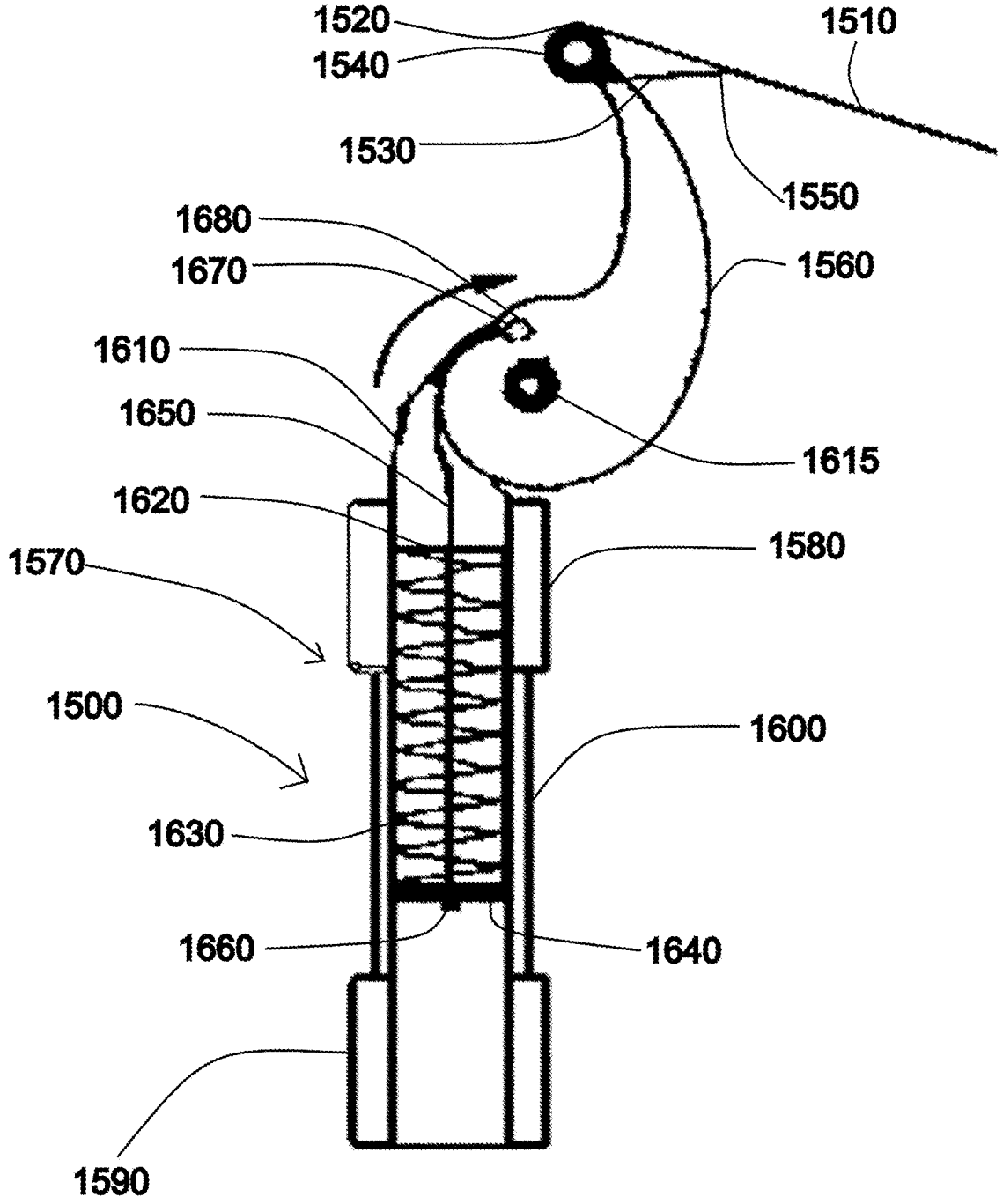
FIG. 13 is a sectional side view through a compression spring lever in its tensioned position.

With reference to FIG. 12 and FIG. 13, a compression spring lever, generally indicated as 1500, is shown attached to a jumping mat 1510. Not the entire trampoline is shown in the interests of showing only the most important features.

The jumping mat 1510 has jumping periphery 1520. The periphery 1520 has a turn-back 1530 of the jumping mat folded around a carbon fibre tube 1540 and sewn back onto the underside of the jumping mat 1510 at a mat attachment 1550.

A rigid element 1560 is attached to carbon fibre tube 1540 through an aperture (not shown) in the jumping mat 1510.

A trampoline frame, generally indicated as 1570, consists of horizontal top bar 1580, and horizontal bottom bar 1590. Other elements of the frame are not shown.

Lever 1500 further comprises a circular cross-section steel upright cylindrical tube 1600 incorporated into the frame 1570 of the trampoline. At the top of the tube 1600 is a rigid element support 1610 connected to the rigid element via a bearing 1615. Tube 1600 also has a fixed disk 1620 welded into it. Tube 1600 houses a compression spring 1630 that at one end abuts against the fixed disk 1620. At its opposite end, it abuts against a moveable disk 1640 that is able to move vertically within tube 1600.

A steel cable 1650 passes through an aperture (not shown) in fixed disk 1620, the centre of compression spring 1630 and an aperture (not shown) in it has a moveable disk nipple. It is secured into position by a moveable disk nipple 1660. The opposite end of the cable 1650 has a rigid element nipple 1670 that is received within a nipple recess 1680 in rigid element 1650.

In use, a plurality of levers 1500 are arranged around the jumping mat periphery 1520, each one attached to the jumping mat 1510 and to the frame 1570 in the same way as depicted in FIG. 12 and FIG. 13.

At rest, the lever 1500 is as depicted in FIG. 12. The jumping mat 1510 is substantially horizontal and uniform in this configuration. In this configuration the compression spring 1630 is under its minimum operating tension and is at its greatest length in the upright tube 1600.

When under tension due to a user (not shown) having jumped down onto the jumping mat 1510, the lever is as depicted in FIG. 13. The rigid element 1560 is rotated in the direction shown by the arrow. This causes the steel cable 1650 to be drawn upwards. The movable disk is forced upwards due to the cable 1650. This, in turn, compresses compression spring 1630 and places it under more tension.

When the downward momentum of the user (not shown) is arrested, the tension stored in compression spring is released by it applying a force against moveable disk 1640, which is transmitted through steel cable 1650 and causes rigid element 1560 to rotate back towards its rest position (FIG. 12). This causes jumping mat 1510 to apply a force to the user in an upwards direction to permit the user to become briefly airborne.

An art-skilled worker will appreciate that a trace spring (having a loop of spring wire at each end) can be used as an alternative and may be advantageous in that it does away with the need for a moveable disc and the loop nearest the jumping mat is connected to the cable and the other loop is connected to the frame of the trampoline (at the bottom bar).

It will be appreciated that the invention broadly consists in the parts, elements and features described in this specification, which when compared to prior art relating to the field, should serve to illustrate the novelty of the invention described herein.

INDUSTRIAL APPLICABILITY

The present invention is applicable to the trampoline manufacturing industry and to the construction and maintenance of trampolines.

What is claimed is:

1. A lever for use in a trampoline comprising:

a frame attachment configured for connection to a supporting frame of the trampoline, the frame attachment comprising a stop formation;

a rigid element connected to the frame attachment:

wherein the rigid element comprises a jump mat end and a frame end;

wherein the rigid element is configured to pivot about a fulcrum connected to the frame attachment;

the rigid element comprising a lug configured to contact the stop formation to limit an extent of a pivot motion of the rigid element about the fulcrum;

the jump mat end being configured for connection to a jumping mat; and a tensioner connected to the rigid element and configured for attachment to the trampoline supporting frame.

2. The lever of claim 1, comprising a rigid housing covering the tensioner.

3. The lever of claim 1, wherein the fulcrum is a bearing, and the rigid element is connected to the supporting frame through the bearing, and wherein the bearing is integrally moulded into the rigid element.

4. The lever of claim 1, wherein the rigid element is moulded with an integrated pivot as a single moulding.

5. The lever of claim 1 comprising an engineering thermoplastic polymer.

6. The lever of claim 5, wherein the engineering thermoplastic polymer is selected from the group consisting of a polyoxymethylene polymer, a composite phenolic, a nylon, polytetrafluoroethylene, ultrahigh-molecular-weight polyethylene and polyamide.

7. The lever of claim 5, wherein the engineering thermoplastic polymer is a polyoxymethylene polymer.

8. The lever of claim 5, wherein the engineering thermoplastic polymer includes a polytetrafluoroethylene additive.

9. The lever of claim 8, wherein the polytetrafluoroethylene additive comprises about 2% by weight of the engineering thermoplastic polymer.

10. The lever of claim 1, wherein the frame attachment is formed of a different material than the fulcrum.

11. The lever of claim 10, wherein the material of the frame attachment possesses a harder wearing property than a material of the fulcrum.

12. The lever of claim 1, wherein the fulcrum comprises glass filled nylon.

13. The lever of claim 1, wherein the frame attachment comprises a bearing pair configured to contact and support the fulcrum.

14. The lever of claim 13, wherein the frame attachment comprises a pair of bearing mounts configured to receive the bearing pair.

15. The lever of claim 14, wherein the stop formation is provided at a top of one of the pair of bearing mounts.

16. A trampoline comprising a plurality of levers, wherein at least one of the plurality of levers is of claim 1, the trampoline comprising:

the jumping mat having a jumping periphery, an upper surface and a lower surface;

the supporting frame located proximal but not directly engaging with the jumping periphery of the jumping mat; and the plurality of levers circumextending the jumping periphery, wherein each of the plurality of levers is configured to apply tension to the jumping mat as a force applied against the jumping periphery of the jumping mat in a direction away from the jumping mat.

17. The trampoline of claim 16, comprising a jumping mat connection located on the lower surface of the jumping mat.

18. The trampoline of claim 17, wherein the jumping mat connection comprises:

a first formation on the lower surface of the jumping mat; and a complementary engaging second formation attached to the jump mat end of the rigid element.

19. The trampoline of claim 18, wherein the first formation is a hook and the second formation is a loop.

20. The trampoline of claim 16, wherein the plurality of levers comprise between 30 and 60 levers, inclusive, arranged and evenly spaced around the jumping mat periphery.

* * * * *